US009555946B1

(12) United States Patent
Warman

(10) Patent No.: US 9,555,946 B1
(45) Date of Patent: Jan. 31, 2017

(54) SUN REFLECTIVE ICE CHEST COVER

(71) Applicant: Gary Wayne Warman, Humble, TX (US)

(72) Inventor: Gary Wayne Warman, Humble, TX (US)

( * ) Notice: Subject to any disclaimer, the term of this patent is extended or adjusted under 35 U.S.C. 154(b) by 0 days.

(21) Appl. No.: 14/661,777

(22) Filed: Mar. 18, 2015

Related U.S. Application Data

(60) Provisional application No. 61/974,692, filed on Apr. 3, 2014.

(51) Int. Cl.
*B65D 81/18* (2006.01)
*B65D 25/28* (2006.01)
*B65D 43/16* (2006.01)

(52) U.S. Cl.
CPC ..... *B65D 81/18* (2013.01); *B65D 25/28* (2013.01); *B65D 43/16* (2013.01); *B65D 2543/00444* (2013.01)

(58) Field of Classification Search
CPC ..... B65D 81/18; B65D 81/3876; B65D 81/38; B65D 90/06; B65D 43/163; B65D 43/16; B65D 25/2835; B65D 25/2838; B65D 25/30; B65D 25/28; A45C 11/20; F25D 3/08
USPC ..... 220/592.11, 592.09, 592.24, 592.21, 220/592.2, 739, 737, 592.03, 220/915.2, 915.1; 150/154, 901; 62/457.7, 457.1
See application file for complete search history.

(56) References Cited

U.S. PATENT DOCUMENTS 212,187 A * 2/1879 Mills ..... B65D 85/324 206/521.1
3,121,522 A * 2/1964 Ragnow ..... A47J 41/0072 206/459.5
4,085,785 A * 4/1978 Hoot ..... B65D 81/3881 206/522
4,867,216 A * 9/1989 McKee ..... B60J 11/00 150/166
6,027,249 A * 2/2000 Bielinski ..... B65D 81/3897 150/156
2007/0000932 A1* 1/2007 Cron ..... B65D 81/3897 220/592.24

* cited by examiner

*Primary Examiner* — Robert J Hicks
(74) *Attorney, Agent, or Firm* — Williams Intellectual Property; Benjamin F. Williams

(57) ABSTRACT

A sun reflective ice chest cover that includes an open-bottomed reflective shell having a high albedo and emissivity, said reflective shell positional enclosing an existing ice chest wherein exposed surfaces of said ice chest are enclose-able interior to said reflective shell and reflection of incident sunlight and radiation of heat away from said ice chest is thereby enabled, whereby the cooler interior is maintainable at lower temperatures for periods longer than temperatures maintained interior to said cooler when used absent said reflective shell.

3 Claims, 4 Drawing Sheets

SUN REFLECTIVE ICE CHEST COVER

CROSS-REFERENCE TO RELATED APPLICATIONS

This nonprovisional application claims the benefit of provisional application No. 61/974,692 filed on Apr. 3, 2014

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of ice chests are known in the prior art. However, what is needed is a lightweight and portable sun reflective ice chest cover that includes an open-bottomed reflective shell having a high albedo and emissivity, said reflective shell positional enclosing an existing ice chest wherein exposed surfaces of said ice chest are encloseable interior to said reflective shell and reflection of incident sunlight and radiation of heat away from said ice chest is thereby enabled, whereby the cooler interior is maintainable at lower temperatures for periods longer than temperatures maintained interior to said cooler when used absent said reflective shell.

FIELD OF THE INVENTION

The present invention relates to sun reflective ice chest cover, and more particularly, to sun reflective ice chest cover that includes an open-bottomed reflective shell having a high albedo and emissivity, said reflective shell positional enclosing an existing ice chest wherein exposed surfaces of said ice chest are encloseable interior to said reflective shell and reflection of incident sunlight and radiation of heat away from said ice chest is thereby enabled, whereby the cooler interior is maintainable at lower temperatures for periods longer than temperatures maintained interior to said cooler when used absent said reflective shell.

SUMMARY OF THE INVENTION

The general purpose of a sun reflective ice chest cover, described subsequently in greater detail, is to provide a sun reflective ice chest cover which has many novel features that result in a sun reflective ice chest cover which is not anticipated, rendered obvious, suggested, or even implied by prior art, either alone or in combination thereof.

The present sun reflective ice chest cover has been devised to provide an expedient means of preserving thermal inertia interior to an extant cooler for periods longer than if said cooler was used in direct sunlight absent the instant sun reflective ice chest cover.

The present sun reflective ice chest cover includes an open-bottomed reflective shell positional overlying and surrounding exposed surfaces of an extant cooler, whereby sunlight otherwise incident said cooler is reflected away from said cooler, and heat generable by said sunlight is likewise reflected and radiated away from the cooler.

The present sun reflective ice chest cover, therefore, includes an open-bottomed reflective shell positional overlying a cooler disposed upon a ground surface. The reflective shell is contemplated to be lightweight and readily portable, and not heavier than the cooler over which said reflective shell is positional. The reflective shell has a high albedo, and may include a mirrored, reflective, or polished surface, of a metallic or vitreous material having a high emissivity whereby heat is readily reflected and radiated from said reflective shell.

The reflective shell further includes a pair of end surfaces and a pair of side surfaces. Each of a pair of handle slots is disposed upon each of the pair of end surfaces whereby each of a pair of handles of an extant cooler positioned underlying the reflective shell is positional therethrough and the extant cooler is thence portable with the reflective shell disposed thereabouts. The reflective shell may also be ported separate from a cooler by means of manual engagement at each of said handle slots.

The reflective shell further includes a hinged lid disposed pivotally connected edgewise atop one of the pair of the side surfaces, whereby the hinged lid is positional between a closed position, enclosing the reflective shell atop each of the pair of side surfaces and each of the pair of end surfaces, and an open position, disposed hinged away from enclosing the reflective shell and pivotally disposed edgewise at one of the pair of side surfaces.

Thus, the present reflective shell is readily positional overlying and surrounding the exposed surfaces of an extant cooler disposed upon a ground surface, wherein light and heat is reflected and radiated from the reflective shell and thereby directed away from a cooler disposed interior to said reflective shell, whereby the interior of said cooler is maintainable at a lower temperature for periods longer than if the cooler was positioned upon a ground surface absent use of the reflective shell.

Thus has been broadly outlined the more important features of the present sun reflective ice chest cover so that the detailed description thereof that follows may be better understood and in order that the present contribution to the art may be better appreciated.

For better understanding of the sun reflective ice chest cover, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
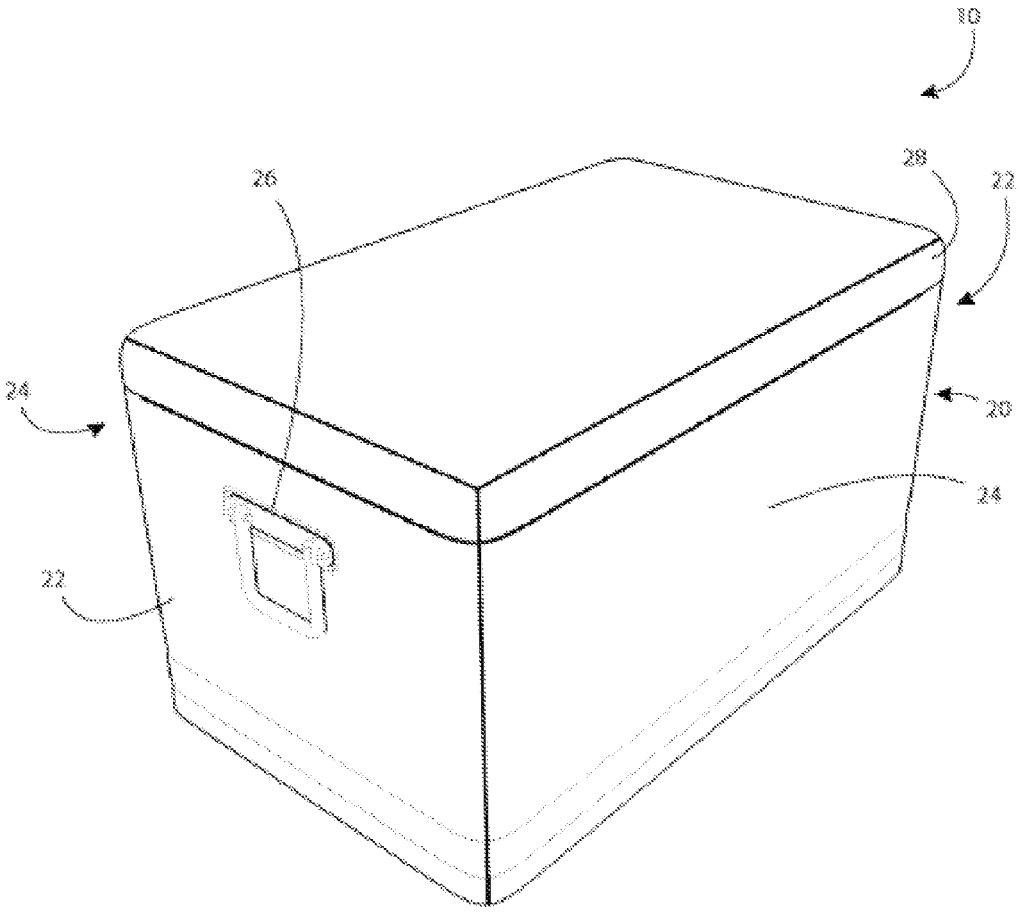
FIG. 1 is an isometric view of an example embodiment of an open-bottomed reflective shell.
Figure 2:
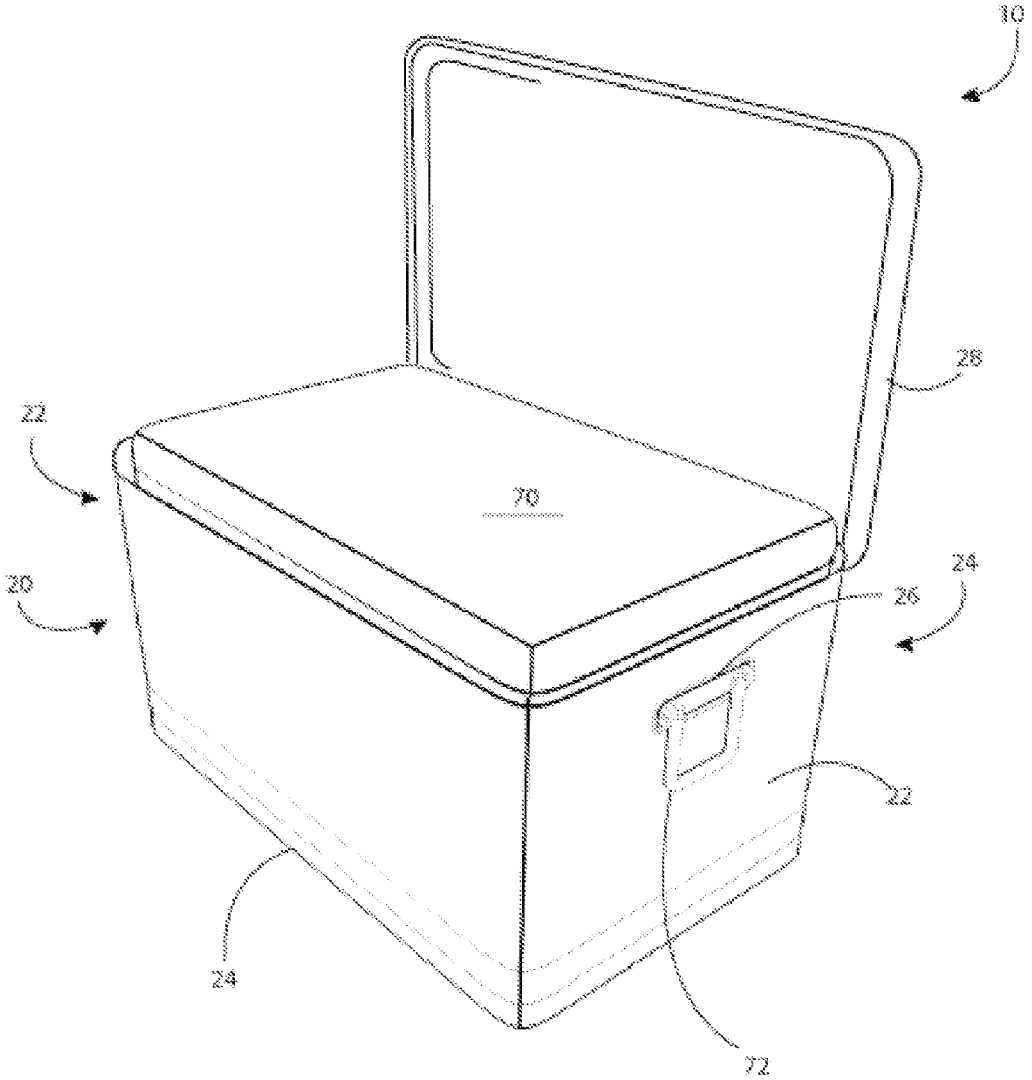
FIG. 2 is an isometric view of an example embodiment of the open-bottomed reflective shell having a hinged lid disposed in an open position whereby an extant cooler, disposed interior to the reflective shell, is visible.
Figure 3:
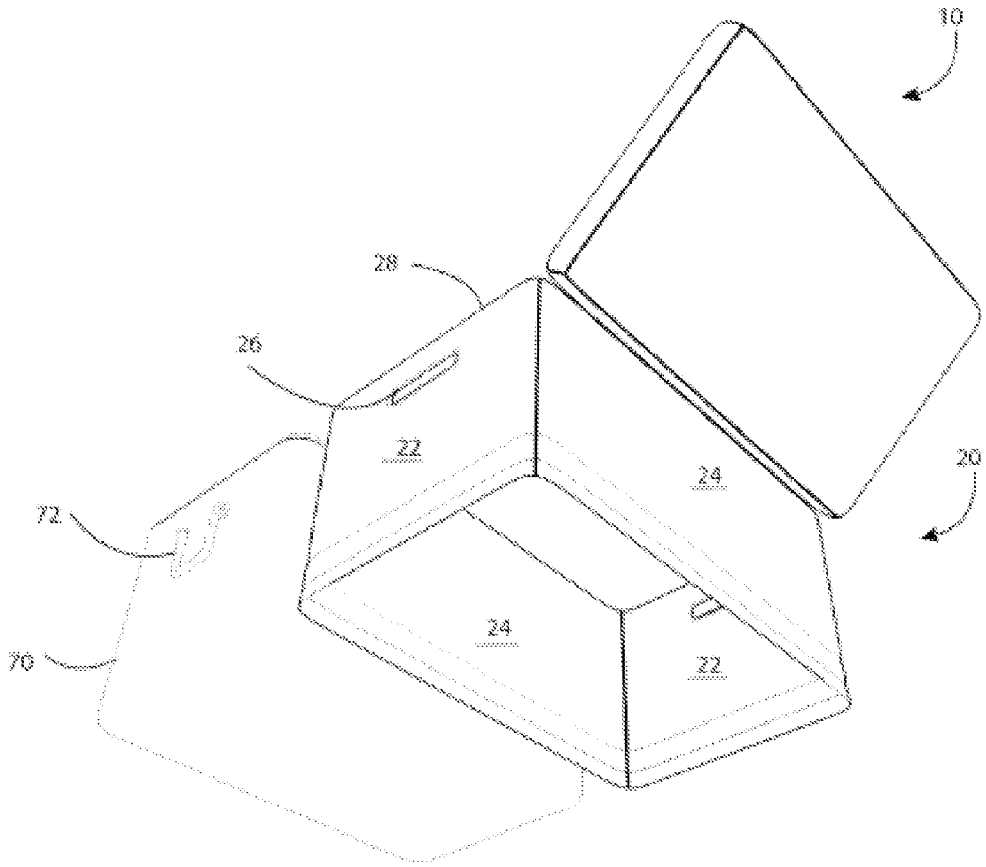
FIG. 3 is an lowered, isometric view of the open-bottomed reflective shell removed from an extant cooler, said reflective shell positional to overlie and surround exposed surfaces of said cooler when said cooler is disposed upon a ground surface.
Figure 4:
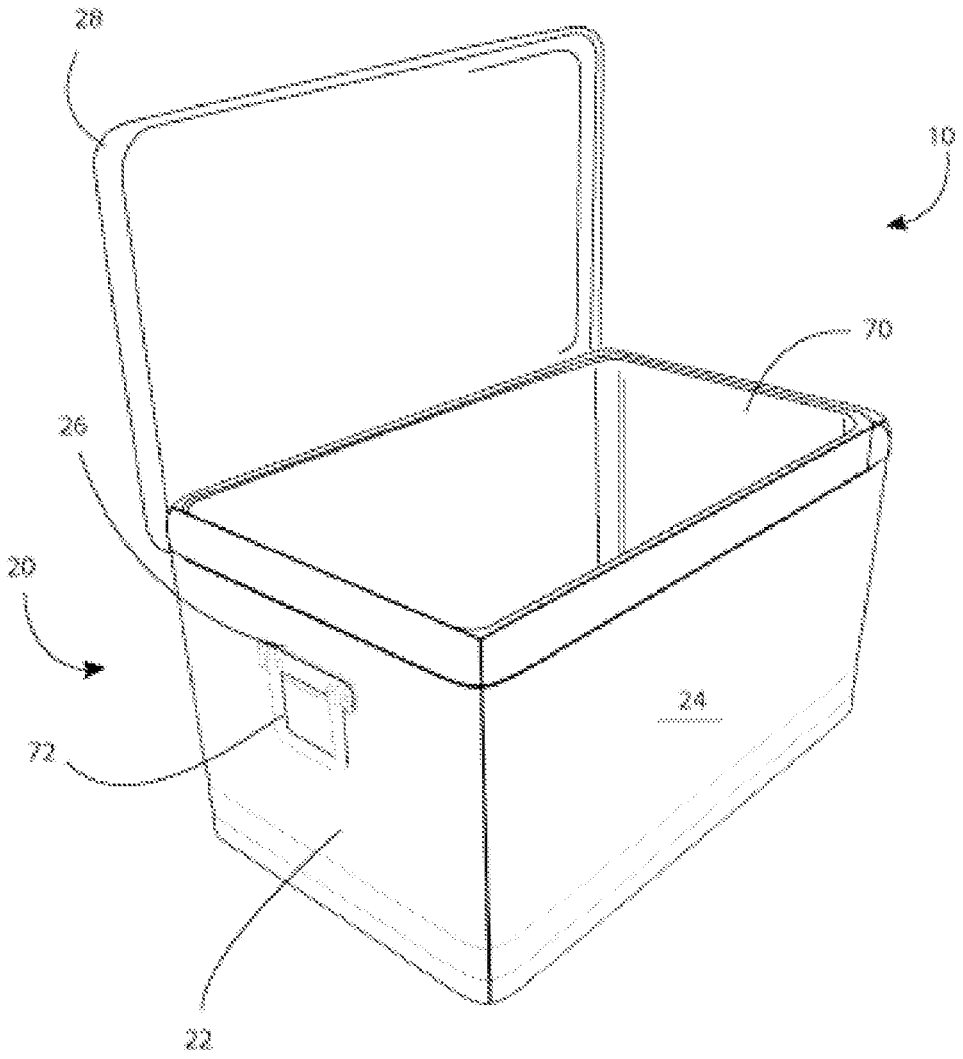
FIG. 4 is an elevated isometric view of an example embodiment of the reflective shell having the hinged lid in an open position wherein an extant cooler is accessible therein, said extant cooler having a lid disposed opened for access to contents storable interior to said cooler.

With reference now to the drawings, and in particular FIGS. 1 through 4 thereof, example of the instant sun reflective ice chest cover employing the principles and concepts of the present sun reflective ice chest cover and generally designated by the reference number 10 will be described.

Referring to FIGS. 1 through 4 a preferred embodiment of the present sun reflective ice chest cover 10 is illustrated.

The present sun reflective ice chest cover 10 has been devised to enable expedient positioning of an open-bottomed reflective shell 20 overlying and surrounding exposed surfaces of an existing cooler 70, whereby the reflective shell 20 is positional encapsulating said cooler 70 and heat generable from sunlight incident said cooler 70 is reflected and radiated from the reflective shell 20 and a colder environment interior the cooler 70 is maintainable for periods longer than if the cooler 70 was left incident sunlight absent enclosure within the reflective shell 20.

The present sun reflective ice chest cover 10, therefore, includes a lightweight, readily portable, open-bottomed, reflective shell 20 dispositional overlying exposed surfaces of an extant cooler 70. The reflective shell 20 has a high albedo, reflective of solar insolation, and may include a polished metallic or vitreous material having a high emissivity, whereby sunlight incident the reflective shell 20 is reflected from said shell 20, and heat generable thereat likewise reflected and radiated away from said shell 20.

The reflective shell 20 includes a pair of end surfaces 22 and a pair of side surfaces 24. Each of a pair of handle slots 26 is disposed upon each of the pair of end surfaces 22 whereby extant handles 72, disposed upon a cooler 70 over which the instant reflective shell 20 is placed, are positional therethrough and ready portage of said extant cooler 70 and reflective shell 20 is enabled concurrently by manual action at said accessible handles 72.

To enable ready access to a cooler 70 positioned interior to the reflective shell 20, a hinged lid 28 is disposed pivotally connected atop one of the pair of side surfaces 24 capping the reflective shell 20. The hinged lid 28 is thereat moveable between an open position, enabling access to an interior of the reflective shell 20, and a closed position, enclosing the reflective shell 20, whereby contents cooled interior to said extant cooler 70 are thereby accessible, when desired, without removing the reflective shell 20 from enclosing exposed surfaces of the cooler 70.

The reflective shell 20 is thus expeditiously positional overlying and surrounding exposed surfaces of an extant cooler 70 seated upon a ground surface, whereby heat generable from sunlight incident the extant cooler 70 is reflected away from said extant cooler 70 and heating of said cooler 70 is preventable longer than if the reflective shell 20 was not positioned overlying and surrounding said exposed surfaces of the cooler 70.

What is claimed is:

1. A sun reflective ice chest cover comprising:

an open-bottomed reflective shell dispositional overlying exposed surfaces of an extant cooler, said reflective shell having a high albedo; and a hinged lid disposed capping the reflective shell, said hinged lid moveable between an open position and a closed position;

wherein the reflective shell is expeditiously positional overlying and surrounding exposed surfaces of an extant cooler whereby heat generable from sunlight incident the extant cooler is reflected away and radiated from said extant cooler and heating of said cooler is preventable longer than if the reflective shell was not positioned overlying and surrounding said exposed surfaces.

2. The sun reflective ice chest cover of claim 1 wherein the reflective shell further comprises:

a pair of end surfaces;

a pair of side surfaces; and each of a pair of handle slots disposed upon each of the pair of end surfaces;

wherein extant handles disposed endwise upon the extant cooler are positional through the pair of handle slots whereby portage of the cooler disposed interior to the reflective shell is readily enabled.

3. A lightweight, readily portable, sun reflective ice chest cover, said sun reflective ice chest cover comprising:

an open-bottomed, reflective shell dispositional overlying exposed surfaces of an extant cooler, said reflective shell having a high albedo, said reflective shell comprising:

a pair of end surfaces;

a pair of side surfaces;

each of a pair of handle slots disposed upon each of the pair of end surfaces; and a hinged lid disposed pivotally connected edgewise atop one of the pair of side surfaces capping the reflective shell, said hinged lid thereat moveable between an open position, enabling interior access to the reflective shell, and a closed position, enclosing the reflective shell;

wherein the reflective shell is expeditiously positional overlying and surrounding exposed surfaces of an extant cooler whereby heat generable from sunlight incident the extant cooler is reflected and radiated away from said extant cooler and heating of said cooler is preventable longer than if the reflective shell was not positioned overlying and surrounding said exposed surfaces.

* * * * *